US007033448B2

(12) United States Patent
Groh et al.

(10) Patent No.: US 7,033,448 B2
(45) Date of Patent: Apr. 25, 2006

(54) METHOD FOR PREPARING A NICKEL-BASE SUPERALLOY ARTICLE USING A TWO-STEP SALT QUENCH

(75) Inventors: Jon Raymond Groh, Loveland, OH (US); Edward Lee Raymond, Maineville, OH (US); Shesh Krishna Srivatsa, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 298 days.

(21) Appl. No.: 10/662,586

(22) Filed: Sep. 15, 2003

(65) Prior Publication Data

US 2005/0056354 A1 Mar. 17, 2005

(51) Int. Cl.
*C22C 1/10* (2006.01)

(52) U.S. Cl. ..... 148/677; 148/675

(58) Field of Classification Search ..... None
See application file for complete search history.

(56) References Cited

U.S. PATENT DOCUMENTS 4,094,709 A 6/1978 Rozmus
4,789,410 A 12/1988 Parizek
4,957,567 A 9/1990 Krueger et al.
5,326,409 A * 7/1994 Couts, Jr. ..... 148/631
5,328,659 A 7/1994 Tillman et al.
5,419,792 A 5/1995 King et al.
6,478,896 B1 * 11/2002 Ganesh et al. ..... 148/428
6,890,370 B1 * 5/2005 Merrick et al. ..... 75/246

OTHER PUBLICATIONS

ASM Handbook, vol. 4, Heat Treating, 1991, pp. 475-483.*

* cited by examiner

*Primary Examiner*—John P Sheehan
(74) *Attorney, Agent, or Firm*—McNees Wallace & Nurick LLC

(57) ABSTRACT

An article made of a nickel-base superalloy strengthened by the presence of a gamma-prime phase is prepared by solution heat treating the nickel-base superalloy at a solutionizing temperature above a gamma-prime solvus temperature of the nickel-base superalloy, thereafter first quenching the nickel-base superalloy in a first molten salt bath maintained at a temperature of from the gamma-prime solvus temperature to about 100° F. below the gamma-prime solvus temperature, thereafter second quenching the nickel-base superalloy in a second molten salt bath maintained at a temperature below an aging temperature of the nickel-base superalloy, and thereafter precipitation heat treating the nickel-base superalloy at the aging temperature to precipitate an aged microstructure having gamma prime phase in a nickel-base matrix.

20 Claims, 5 Drawing Sheets

METHOD FOR PREPARING A NICKEL-BASE SUPERALLOY ARTICLE USING A TWO-STEP SALT QUENCH

This invention relates to the preparation of a heat-treated nickel-base superalloy article and, more particularly, to using a two-step salt quench during the solution-treating portion of the processing.

BACKGROUND OF THE INVENTION

Nickel-base superalloys are strengthened by the precipitation of the gamma-prime (γ') phase. The gamma-prime phase is produced by heating the nickel-base superalloy to a temperature above the gamma-prime solvus to form a solid solution, quenching the solutionized alloy to low temperature, and then precipitation-heat-treating the solutionized-and-quenched alloy at an intermediate aging temperature. The result is a distribution of gamma-prime phase in a nickel-alloy matrix. A high volume fraction of gamma-prime phase is desired to provide high strength. However, a high volume of gamma-prime phase presents processing challenges because the material has low ductility at the processing temperatures.

Nickel-base superalloys used in creep-limited applications are desirably coarse grained. The coarse-grain microstructure is produced during the high-temperature solution treatment, because the grains rapidly coarsen at this temperature. The coarse-grain microstructure is more creep resistant than is a fine-grain microstructure. However, the coarse-grain microstructure is less ductile in intermediate temperature ranges than is the fine-grain microstructure, so that the coarse-grain microstructure may be subject to quench cracks during the quenching that follows the solution treatment. The desirable high-volume-fraction of gamma-prime phase makes the alloy even more prone to cracking due to the reduced ductility.

An additional problem is encountered when the nickel-base superalloy is utilized to make an article such as a disk (rotor) used in the turbine section of a gas-turbine engine. Such articles may have a widely varying section thickness, from relatively thin near the rim to relatively thick near the hub. When such an article is solution-treated-and-quenched, there is a significant variation in the cooling rate of the regions of different thicknesses, as well as between the center and the surface of the thick sections, leading to large residual strains and stresses within the article. These residual strains and stresses lead to distortion of the article during subsequent machining and service. While the residual strains and stresses may be relaxed somewhat by a stabilization heat treatment prior to the precipitation heat treatment, the stabilization heat treatment leads to a reduction in the strength properties of the article after aging.

There have been a number of processes developed to achieve good mechanical properties while alleviating the problems associated with the limited ductility of the coarse-grain microstructure. A fan cool from the solution treatment provides an intermediate cooling rate between a slow cooling rate (i.e., air cooling) that leads to reduced residual stress but also reduced strength, and a faster cooling rate (e.g., water quench, oil quench, one-step molten salt quench) that produces increased strength but also increased risk of cracking, distortion, and residual stresses. Other techniques include the use of differential cooling rates, where one portion of the article is cooled at a slower rate and another portion is cooled at a faster rate, as with jets of liquid or gas. While all of the prior techniques are operable to some extent, none has been found to be fully satisfactory in achieving a desirable compromise in mechanical properties with no cracking, low distortion, and low residual stresses.

There is accordingly a need for an improved approach to the solution treating, quenching, and precipitation heat treating of nickel-base superalloys, particularly those that have coarse grains and high volume fractions of gamma-prime phase, and are shaped as articles with thick sections and/or varying section thicknesses. The present invention fulfills this need, and further provides related advantages.

SUMMARY OF THE INVENTION

The present invention provides a method for preparing a nickel-base superalloy strengthened by the presence of a gamma-prime phase. Properties comparable to those of other quench methods are obtained using an improved quenching approach from the solutionizing temperature. The present approach may be used to make articles with thick and/or highly varying section thicknesses, without inducing unacceptably large thermal strains and stresses (thereby reducing the risk of quench cracks), and distortions.

A method for preparing an article made of a nickel-base superalloy strengthened by the presence of a gamma-prime phase comprises the steps of providing an initial article of the nickel-base superalloy, and thereafter solution heat treating the nickel-base superalloy at a solutionizing temperature above a gamma-prime solvus temperature of the nickel-base superalloy. The method further includes thereafter first quenching the nickel-base superalloy in a first molten salt bath maintained at a temperature of from the gamma-prime solvus to about 100° F. below the gamma-prime solvus temperature, thereafter second quenching the nickel-base superalloy in a second molten salt bath maintained at a temperature below an aging temperature of the nickel-base superalloy, and thereafter precipitation heat treating the nickel-base superalloy at the aging temperature to precipitate an aged microstructure comprising gamma prime phase in a nickel-base matrix.

The initial article may have a coarse grain size initially, or a coarse grain size may be produced during the solution heat treating step. Specifically, the article may have an average grain size coarser than ASTM 10 at the conclusion of the step of solution heat treating. The physical grain size decreases with increasing ASTM grain size number, and therefore the article with the coarser average grain size has an ASTM grain size number of less than ASTM 10 at the conclusion of the solution heat treating.

The initial article may have a thick section, and/or a section thickness that varies substantially in different portions of the article. The initial article thus may have a greatest thickness dimension of not less than about 3 inches. An example of such a thick article is a disk (also termed a "rotor") used in a gas turbine engine. Such an article also may have a difference between a greatest section thickness and a smallest section thickness of at least about 2 inches. In a typical case, the initial article has thickness dimensions ranging from about 1 inch to about 8 inches in different portions of the article. The large section thicknesses and large variations in thickness in different portions of the article are required so that the article may achieve its required mechanical performance. In such articles, these large section thicknesses and large differences in the thickness in various portions of the article impose difficulties not experienced in relatively thin articles, due to the cooling temperature gradients, the differences between center and surface temperatures, and the magnitude of the thermal energy that must be removed from the article during cooling.

In one embodiment, the nickel-base superalloy is maintained in the first molten salt bath for a time of at least about 5 minutes, preferably for a time of from about 5 to about 30 minutes. In another embodiment, the nickel-base superalloy is maintained in the second molten salt bath for a time of at least about 10 minutes.

Preferably but not necessarily, after the step of second quenching and before the step of precipitation heat treating, there is a step of cooling the nickel-base superalloy to room temperature. Optionally, after the step of second quenching and before the step of precipitation heat treating, the nickel-base superalloy is stabilized at a stabilizing temperature of from about, 100° F. to about 200° F. above the aging temperature. Preferably, the aged microstructure of the nickel-base superalloy has a volume percentage of gamma-prime phase of at least about 40 percent, to achieve high strength. After precipitation heat treating, the article may be further processed, as by intermediate and/or final machining.

More specifically in a preferred embodiment, a method for preparing an article made of a nickel-base superalloy strengthened by the presence of a gamma-prime phase comprises the steps of providing an initial article of the nickel-base superalloy, thereafter solution heat treating the nickel-base superalloy at a solutionizing temperature above the gamma-prime solvus of about 2030° F., preferably from about 2050° F. to about 2150° F., thereafter first quenching the nickel-base superalloy in a first molten salt bath maintained at a temperature of from about 1930° F. to about 2000° F., thereafter second quenching the nickel-base superalloy in a second molten salt bath maintained at a temperature of from about 900° F. to about 1300° F., and thereafter precipitation heat treating the nickel-base superalloy at an aging temperature of from about 1300° F. to about 1500° F. Other compatible features and aspects discussed herein may be used in conjunction with this embodiment. Stabilization heat treatment, where used, is preferably performed at a stabilizing temperature of from about 100° F. to about 200° F. above the aging temperature.

The present approach achieves a quench cooling rate that is sufficiently fast to retain the required supersaturation of solute elements that are subsequently precipitated as the gamma-prime precipitate, but not so fast as to produce unacceptably high residual strains and stresses, distortion, and quench cracking. The present approach utilizes molten salt baths, an established technology for other processes, to initially cool the hot article relatively quickly by conduction and convection, and then cause the temperature of the article to approach that of the salt bath so as to better (but not necessarily perfectly) equalize the temperature throughout the article. The molten salt bath, because of its high convective heat transfer coefficient, causes rapid cooling of the article. However, since the article cannot cool below the temperature of the molten salt bath when immersed in the molten salt bath, the temperature differentials within the article are maintained low, in spite of the rapid temperature change. The more-uniform temperature throughout the section thickness of the article reduces the tendency toward the creation of residual strains and stresses, distortion, and quench cracking. This method also promotes microstructural homogeneity and uniform material properties throughout the part.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
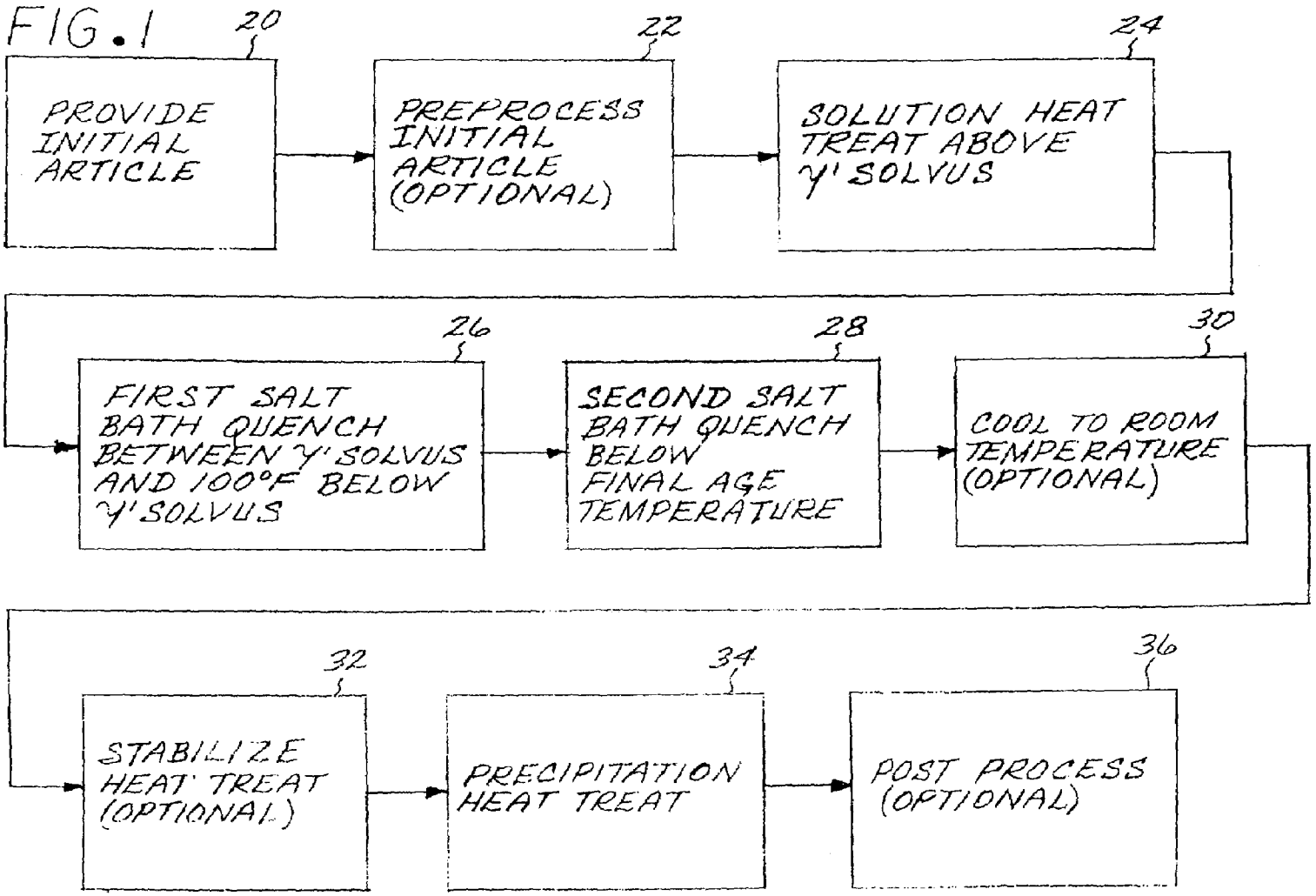
FIG. 1 is a block flow diagram of a preferred approach for practicing an embodiment of the present method.
Figure 2:
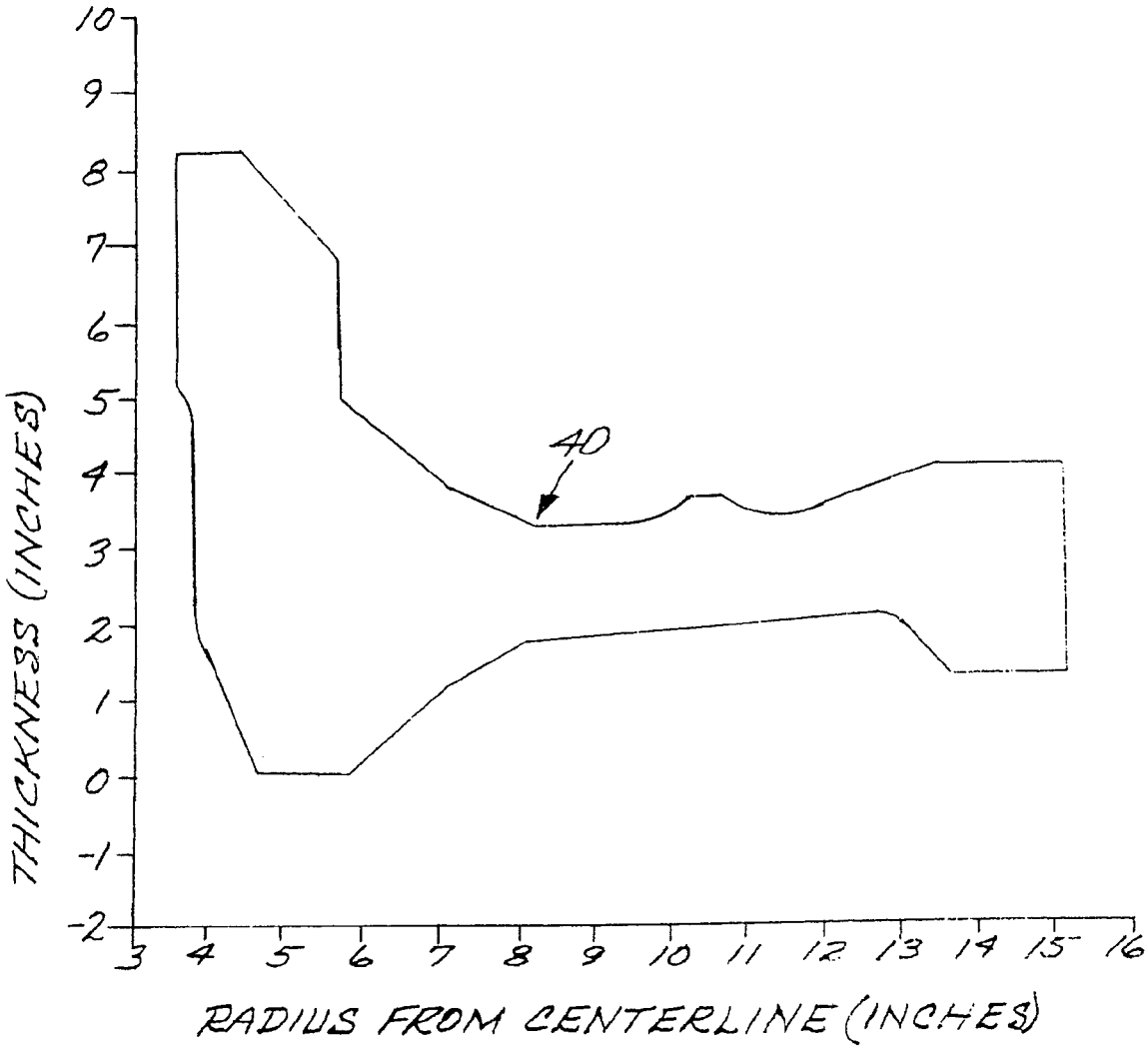
FIG. 2 is a sectional center-to-rim view of an exemplary article that may be processed by the present approach, a turbine disk, with thickness and distance-from-axial-centerline dimensions of the exemplary article indicated.

FIG. 1 illustrates a method for preparing an article made of a nickel-base superalloy strengthened by the presence of gamma-prime (γ') phase. The method includes first providing an initial article of the nickel-base superalloy, step 20. The initial article may be of any operable type. An example of interest is a disk 40, also termed a rotor, used in a gas turbine engine, as shown in sectional center-to-rim view in FIG. 2 with dimensions for a typical case. Preferably, the initial article, a gas turbine disk pancake or contoured blank, has a greatest thickness dimension through a section, in at least some portions of the article as shown in FIG. 2, of not less than about 3 inches. More preferably, a difference between a greatest section thickness and a smallest section thickness is at least about 2 inches. These dimensions and dimensional differences are found to otherwise produce significantly greater problems in the heat treating than smaller dimensions and dimensional differences.

The article is made of a nickel-base superalloy. As used herein, "nickel-base" means that the composition has more nickel present than any other element. The nickel-base superalloys are of a composition that is strengthened by the precipitation of gamma-prime phase in a nickel-alloy matrix. (As used herein, "gamma-prime" includes gamma-prime phase and related phases such as gamma double-prime phase.) An example of a specific nickel-base superalloy composition of interest is Rene™ 88DT, having a nominal composition, in weight percent, of 13 percent cobalt, 16 percent chromium, 4 percent molybdenum, 3.7 percent titanium, 2.1 percent aluminum, 4 percent tungsten, 0.75 percent niobium, 0.015 percent boron, 0.03 percent zirconium, 0.05 percent carbon, up to about 0.5 percent iron, balance nickel and minor impurity elements.

Preferably, the aged microstructure of the nickel-base superalloy has a volume percentage of gamma-prime phase of at least about 40 percent. This relatively high volume fraction of gamma-prime phase produces excellent mechanical properties in the final product in service, as desired for advanced applications requiring the greatest service performance. However, the high volume fraction of gamma-prime phase reduces the ductility of the nickel-base superalloy in intermediate temperature ranges so as to cause heat treating difficulties not found in alloys with lower volume percentages of gamma-prime phase.

The initial article may optionally be pre-processed in any operable manner, step 22. For example, the initial article may be forged, machined, cleaned, or the like.

The nickel-base superalloy is thereafter solution heat treated at a solutionizing temperature above a gamma-prime solvus temperature of the nickel-base superalloy, step 24. The gamma-prime solvus temperature is the temperature above which, in equilibrium, the gamma-prime phase is unstable and dissolves. The gamma-prime solvus temperature is a characteristic of each particular alloy composition. For Rene™ 88DT, the gamma-prime solvus temperature on heating is about 2030° F. The preferred solutionizing temperature for Rene™ 88DT is from about 2050° F. to about 2150° F., most preferably about 2100° F. The duration of the solution heat treating is preferably at least about 1 hour. The solution heat treatment 24 has two effects. First, it dissolves any gamma-prime phase that is present in the material to produce a high-temperature solid solution. Second, because of the high temperature, the grains of the initial article grow, so that the average grain size is preferably coarser than about ASTM 10 at the conclusion of the step of solution heat treating 24. (The physical grain size decreases with increasing ASTM grain size number, and therefore the article after solution heat treating 24 desirably has an ASTM grain size number of less than ASTM 10.) This large grain size is desirable in articles such as disks whose service temperature is moderately high so that the article is subjected to creep loadings during service.

The nickel-base superalloy is thereafter first quenched in a first molten salt bath maintained at a temperature of up to about 100° F. below the gamma-prime solvus temperature, step 26. In the case of the Rene™ 88DT superalloy article, the first molten salt bath is maintained at a temperature of from about 1930° F. to about 2000° F., most preferably about 1975° F. The first molten salt bath is sufficiently large in size that the entire article maybe immersed into the first molten salt bath. The nickel-base superalloy is preferably maintained in the first molten salt bath for a time of at least about 5 minutes, and more preferably for a time of from about 5 to about 30 minutes. This period in the first molten salt bath allows the temperature within the relatively thick article to partially equilibrate throughout the section.

The nickel-base superalloy is thereafter second quenched in a second molten salt bath maintained at a temperature below an aging temperature of the nickel-base superalloy, step 28. The second quenching 28 is accomplished by transferring the article from the first molten salt bath and immersing it into the second molten salt bath. The second molten salt bath is sufficiently large in size that the entire article may be immersed into the second molten salt bath. In a typical case, the aging temperature is on the order of from about 1300° F. to about 1500° F., and the preferred aging temperature is about 1400° F. The second molten salt bath is therefore maintained at a lower temperature, preferably from about 900° F. to about 1300° F., and most preferably about 1000° F. The nickel-base superalloy is preferably maintained in the second molten salt bath for a time of at least about 10 minutes. The nickel-base superalloy maybe maintained in the second molten salt bath for extended periods of time without harm.

Figure 3:
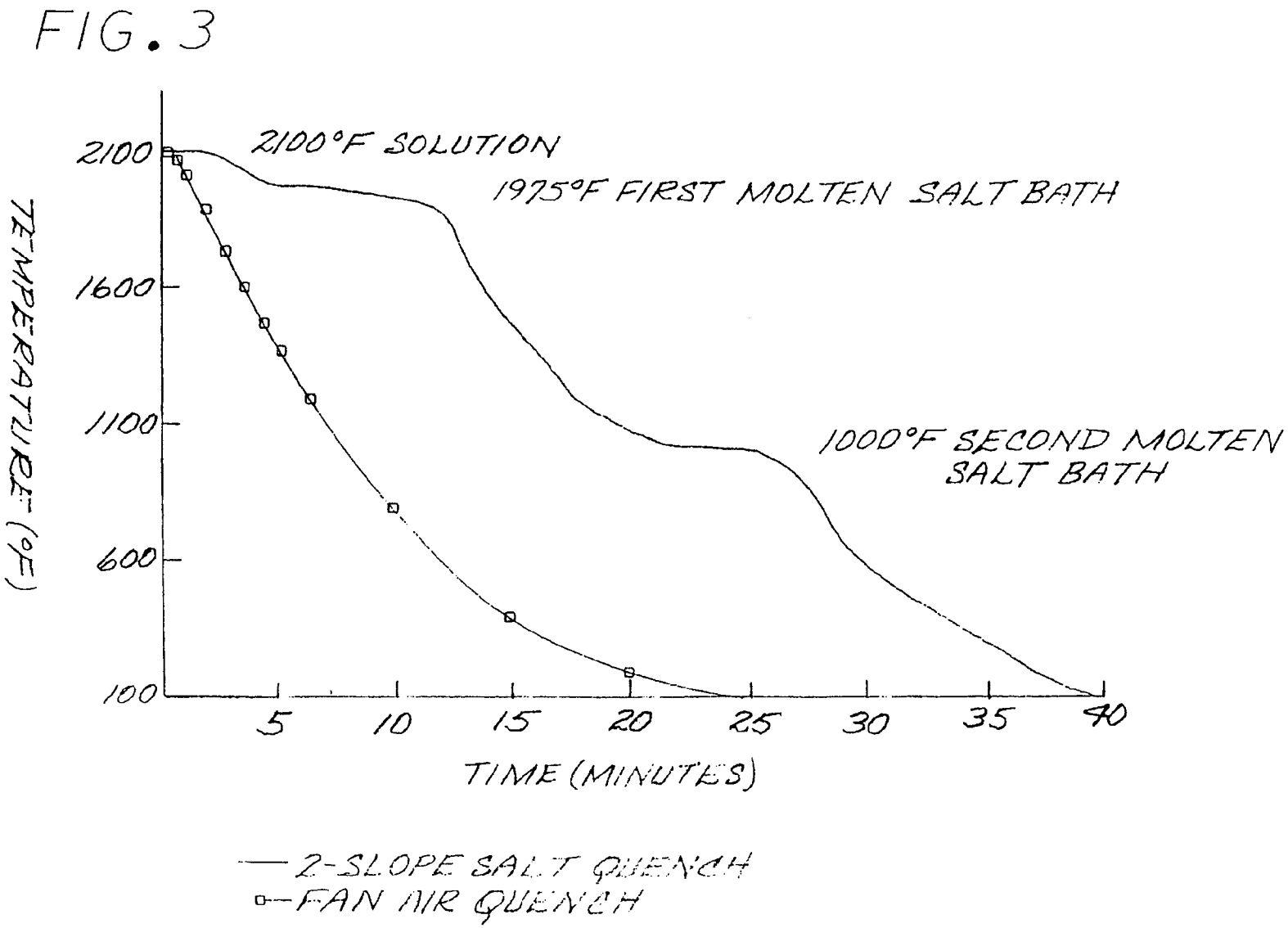
FIG. 3 is a graph of temperature as a function of time for the present two-step salt-bath quenching approach and for fan air quenching.

FIG. 3 shows a typical cooling curve of centerline temperature of the article as a function of time for the preferred form of the present two-step approach, as compared with a conventional fan cooling approach. The fan cooling approach is the previously most preferred quench cooling technique for the disks, as described in U.S. Pat. No. 5,419,792, whose disclosure is incorporated by reference. As may be seen from FIG. 3, the present approach has a lower initial cooling rate when the article is immersed into the first molten salt bath, since heat is being removed to a medium at 1975° F. in this case, rather than ambient temperature air. The article tends to equilibrate to the temperature of the first molten salt bath in step 26, allowing internal stresses to equilibrate. The subsequent second salt bath quench 28 achieves an initial cooling rate comparable with that of the fan cooling, but within increasing time the article approaches and equilibrates at the temperature of the second molten salt bath, 1000° F. in this case.

The partial equilibration at the temperature of the first molten salt bath is highly desirable, and therefore the present two-step approach may not be replaced by a one-step approach in which the article is immersed into a molten salt bath at a lower temperature such as the temperature of the second molten salt bath, 1000° F. in this case. The one-step quench in molten salt would produce a cooling curve similar to that of the fan air cool, which is generally steeper and therefore faster than that of the two-step salt bath approach, and allows less time for temperature equilibration. That faster cooling produces too great a variation in cooling rate between thick and thin sections, as well as between the center and the surface of sections. By achieving thermal equilibrium to within 25° F. at a temperature slightly below the gamma-prime solvus in the present two-step approach, the amount of thermal energy that must be removed during the final quench is significantly reduced, as compared with the same article that is in the as-solutionized condition (i.e., at about 2100° F.). The temperature equilibration precipitates a small fraction of the gamma-prime phase to generate strength and ductility, while retaining sufficient supersaturation to achieve desirable microstructure and properties after the subsequent heat treat cycle(s).

Optionally, after the step 28 of second salt bath quenching, the nickel-base superalloy may be cooled to room temperature, step 30. The cooling 30 may be accomplished by any operable approach, but is typically performed by removing the article from the second salt bath and allowing it to air cool to room temperature.

Optionally, after the step of second quenching 28 and before the next step of precipitation heat treating, the article may be stabilize heat treated at a stabilizing temperature of from about 100° F. to about 200° F. above the aging temperature, step 32. Where the aging temperature is about 1400° F., the stabilizing heat treatment 32 is preferably performed at a temperature of about 1550° F. for a time of about 4 hours. The stabilizing heat treatment aids in relaxing the strains and stresses produced during cooling. On the other hand, the stabilizing heat treatment 32, where used, tends to reduce the effectiveness of the subsequent precipitation heat treating, with the result that the final properties of the superalloy article are reduced as compared with those in the absence of the stabilizing heat treatment.

The nickel-base superalloy is thereafter precipitation heat treated, step 34, at the aging temperature to precipitate an aged microstructure comprising gamma prime phase in a nickel-base matrix. The preferred aging temperature for the Rene™ 88DT alloy is from about 1300° F. to about 1500° F., most preferably about 1400° F. The preferred aging time at 1400° F. is about 8 hours. Desirably, the aged microstructure has a volume percentage of gamma prime phase of at least about 40 percent.

The solution heat treated, two-step quenched, and aged article may thereafter optionally be post processed in any operable manner, step 36. In a typical case, the article such as the disk is final machined, and it may also be coated with a protective coating.

Figure 4:
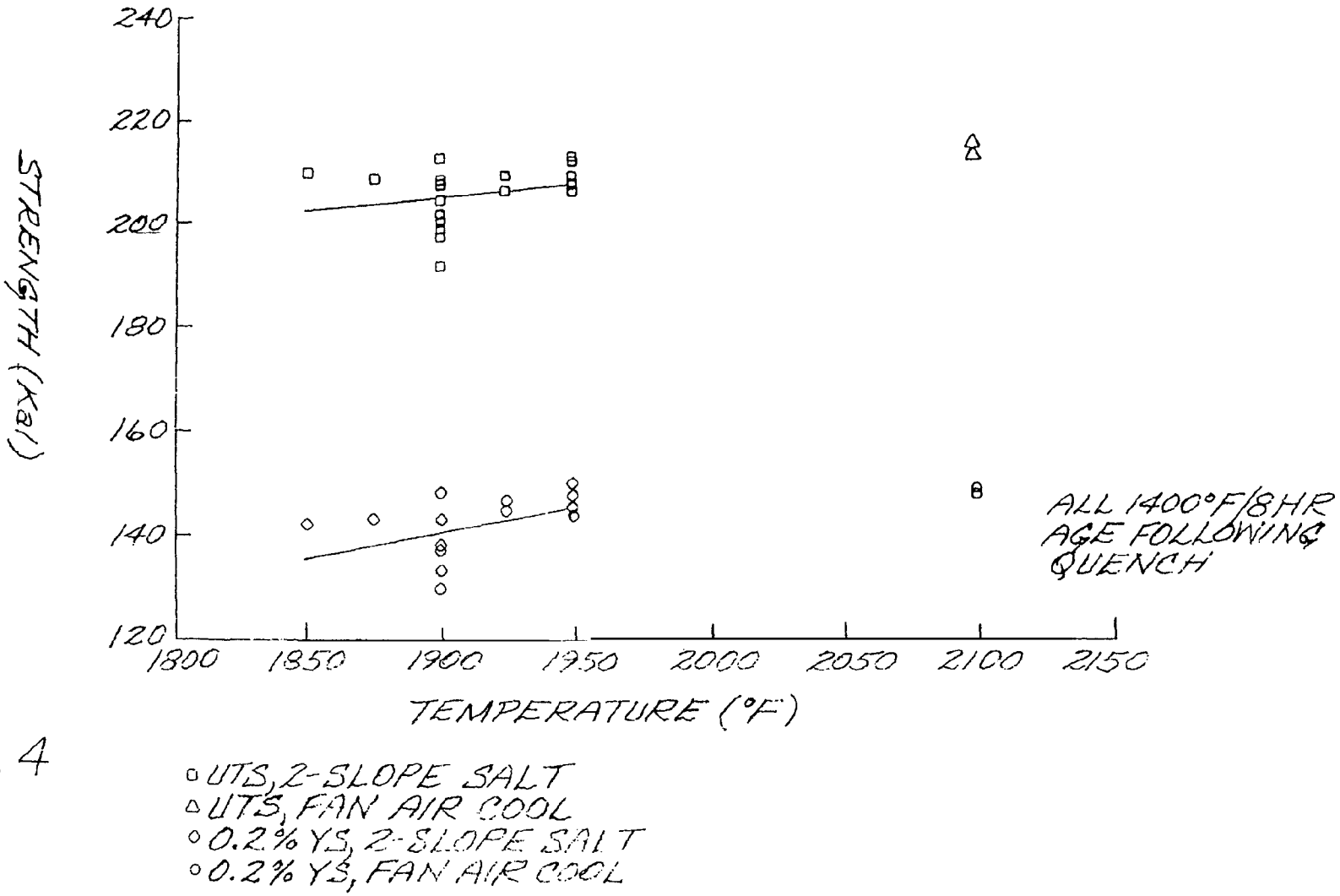
FIG. 4 is a graph presenting comparative results for two-step salt-bath quenching versus fan air cooling, for the ultimate strength and yield strength of Rene™ 88DT alloy measured at 1200° F., as a function of the temperature of the first salt bath.
Figure 5:
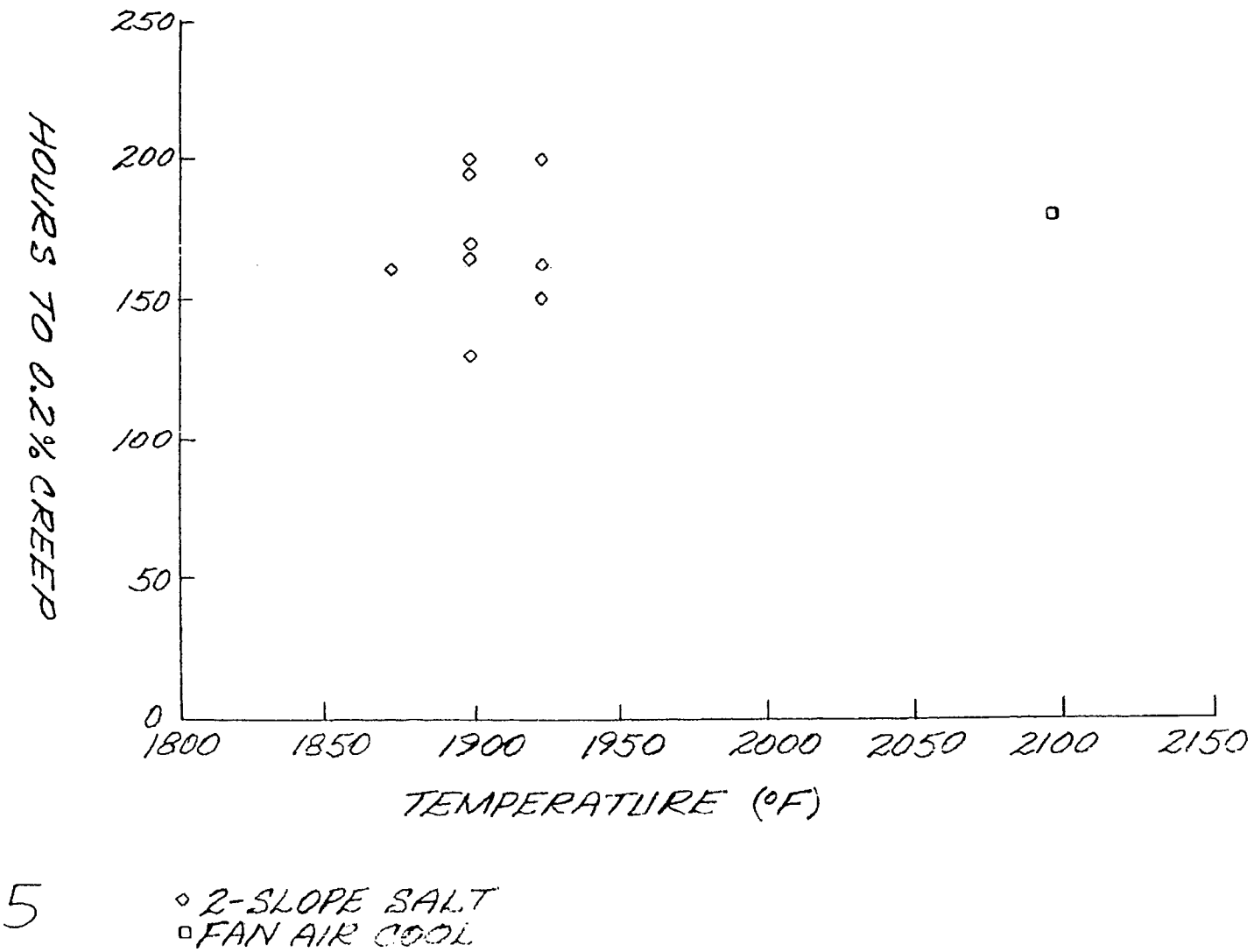
FIG. 5 is a graph presenting comparative results for two-step salt-bath quenching versus fan air cooling, for the 1300° F./100 ksi creep of Rene™ 88DT alloy, as a function of the temperature of the first salt bath.

The present invention has been reduced to practice. Specimens of Rene™ 88DT were prepared in the preferred manner described above, and aged at 1400° F. for 8 hours. Comparative specimens were processed in the same manner, except that the quenching was accomplished by fan air cooling to room temperature rather than by the two-step salt bath quench. The cooling rates are as shown in FIG. 3. The specimens were mechanically tested in tension and creep, and the results are shown respectively in FIGS. 4–5. Temperatures below about 1930° F. for the temperature of the first molten salt bath result in reduced mechanical properties as compared with the fan air cooled approach. From these data, the preferred temperature of the first salt bath, 1975° F., was established.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for preparing an article made of a nickel-base superalloy strengthened by the presence of a gamma-prime phase, comprising the steps of providing an initial article of the nickel-base superalloy; thereafter solution heat treating the nickel-base superalloy at a solutionizing temperature above a gamma-prime solvus temperature of the nickel-base superalloy; thereafter first quenching the nickel-base superalloy in a first molten salt bath maintained at a temperature of from the gamma-prime solvus to about 100° F. below the gamma-prime solvus temperature; thereafter second quenching the nickel-base superalloy in a second molten salt bath maintained at a temperature below an aging temperature of the nickel-base superalloy; and thereafter precipitation heat treating the nickel-base superalloy at the aging temperature to precipitate an aged microstructure comprising gamma prime phase in a nickel-base matrix.

2. The method of claim 1, wherein the article has an average grain size coarser than ASTM 10 at the conclusion of the step of solution heat treating.

3. The method of claim 1, wherein the step of providing the initial article includes the step of providing the initial article having a largest thickness dimension of not less than about 3 inches.

4. The method of claim 1, wherein the step of providing the initial article includes the step of providing the article wherein a difference between a greatest section thickness and a smallest section thickness is at least about 2 inches.

5. The method of claim 1, wherein the step of providing the initial article includes the step of providing a gas turbine disk blank wherein a difference between a greatest section thickness and a smallest section thickness is at least about 2 inches.

6. The method of claim 1, wherein the step of first quenching includes the step of maintaining the nickel-base superalloy in the first molten salt bath for a time of at least about 5 minutes.

7. The method of claim 1, wherein the step of first quenching includes the step of maintaining the nickel-base superalloy in the first molten salt bath for a time of from about 5 to about 30 minutes.

8. The method of claim 1, wherein the step of second quenching includes the step of maintaining the nickel-base superalloy in the second molten salt bath for a time of at least about 10 minutes.

9. The method of claim 1, including an additional step, after the step of second quenching and before the step of precipitation heat treating, of cooling the nickel-base superalloy to room temperature.

10. The method of claim 1, including an additional step, performed after the step of second quenching and before the step of precipitation heat treating, of stabilize heat treating the nickel-base superalloy at a stabilizing temperature of from about 100° F. to about 200° F. above the aging temperature.

11. The method of claim 1, wherein the step of precipitation heat treating includes the step of precipitation heat treating the nickel-base superalloy to produce the aged microstructure having a volume percentage of gamma prime phase of at least about 40 percent.

12. The method of claim 1, including an additional step, after the step of precipitation heat treating, of machining the nickel-base superalloy.

13. A method for preparing an article made of a nickel-base superalloy strengthened by the presence of a gamma-prime phase, comprising the steps of providing an initial article of the nickel-base superalloy; thereafter solution heat treating, the nickel-base superalloy at a solutionizing temperature above about 2030° F.; thereafter first quenching the nickel-base superalloy in a first molten salt bath maintained at a temperature of from about 1930° F. to about 2000° F.; thereafter second quenching the nickel-base superalloy in a second molten salt bath maintained at a temperature of from about 900° F. to about 1300° F.; and thereafter precipitation heat treating the nickel-base superalloy at an aging temperature of from about 1300° F. to about 1500° F.

14. The method of claim 13, wherein the article has an average grain size coarser than ASTM 10 at the conclusion of the step of solution heat treating.

15. The method of claim 13, wherein the step of providing the initial article includes the step of providing a gas turbine disk blank wherein a difference between a greatest section thickness and a smallest section thickness is at least about 2 inches.

16. The method of claim 13, including an additional step, performed after the step of second quenching and before the step of precipitation heat treating, of stabilize heat treating the nickel-base superalloy at a stabilizing temperature of from about 100° F. to about 200° F. above the aging temperature.

17. The method of claim 13, wherein the step of precipitation heat treating includes the step of precipitation heat treating the nickel-base superalloy to produce the aged microstructure having a volume percentage of gamma prime phase of at least about 40 percent.

18. A method for preparing an article made of a nickel-base superalloy strengthened by the presence of a gamma-prime phase, comprising the steps of providing a gas turbine disk initial article the nickel-base superalloy, wherein the initial article has a thickness dimension ranging from about 2 to about 7 inches; thereafter solution heat treating the nickel-base superalloy at a solutionizing temperature of from about 2050° F. to about 2150° F.; thereafter first quenching the nickel-base superalloy in a first molten salt bath maintained at a temperature of from about 1930° F. to about 2000° F. and maintaining the nickel-base superalloy in the first molten salt bath for a time of at least about 5 minutes; thereafter second quenching the nickel-base superalloy in a second molten salt bath maintained at a temperature of from about 900° F. to about 1300° F. and maintaining the nickel-base superalloy in the second molten salt bath for a time of at least about 10 minutes; and thereafter precipitation beat treating the nickel-base superalloy at an aging temperature of from about 1300° F. to about 1500° F.

19. The method of claim 18, including an additional step, performed after the step of second quenching and before the step of precipitation heat treating, of stabilize heat treating the nickel-base superalloy at a stabilizing temperature of from about 100° F. to about 200° F. above the aging temperature.

20. The method of claim 18, wherein the step of precipitation heat treating includes the step of precipitation heat treating the nickel-base superalloy to produce an aged microstructure having a volume percentage of gamma prime phase of at least about 40 percent.

* * * * *